US011143408B2

(12) United States Patent
Lin

(10) Patent No.: US 11,143,408 B2
(45) Date of Patent: Oct. 12, 2021

(54) PORTABLE BURNING STOVE PROVIDING WARM AIR

(71) Applicant: Yao-Hsin Lin, Taichung (TW)

(72) Inventor: Yao-Hsin Lin, Taichung (TW)

( * ) Notice: Subject to any disclaimer, the term of this patent is extended or adjusted under 35 U.S.C. 154(b) by 195 days.

(21) Appl. No.: 16/580,127

(22) Filed: Sep. 24, 2019

(65) Prior Publication Data

US 2020/0378606 A1 Dec. 3, 2020

(30) Foreign Application Priority Data

May 31, 2019 (TW) ..... 108206978

(51) Int. Cl.

| | |
|---|---|
| ***F24B 1/00*** | (2006.01) |
| ***F23B 20/00*** | (2006.01) |
| ***F23B 30/00*** | (2006.01) |
| ***F24B 9/00*** | (2006.01) |
| ***F24B 5/02*** | (2006.01) |
| ***F24B 1/02*** | (2006.01) |

(52) U.S. Cl.

CPC ..... *F24B 1/003* (2013.01); *F23B 7/002* (2013.01); *F23B 20/00* (2013.01); *F24B 1/028* (2013.01); *F24B 5/023* (2013.01); *F24B 9/00* (2013.01)

(58) Field of Classification Search

CPC ..... F23B 7/002; F23B 20/00; F23B 80/04; F24B 5/023; F24B 1/022

See application file for complete search history.

(56) References Cited

U.S. PATENT DOCUMENTS

| | | | | |
|---|---|---|---|---|
| 4,430,986 | A * | 2/1984 | Thalis | F24B 13/004 126/285 A |
| 5,617,842 | A * | 4/1997 | Champion | F24B 1/181 126/523 |
| 2013/0104873 | A1* | 5/2013 | Henry | F24H 3/088 126/107 |
| 2018/0195732 | A1* | 7/2018 | Drummond | A47J 37/0704 |
| 2018/0372325 | A1* | 12/2018 | Sanders | F24B 1/02 |

* cited by examiner

*Primary Examiner* — David J Laux

(74) *Attorney, Agent, or Firm* — Alan D. Kamrath; Karin L. Williams; Mayer & Williams PC

(57) ABSTRACT

A burning stove includes a stove body, a front seat, a door, a rear seat, a top cover, and a baffle. The baffle divides the stove body into an air inlet chamber and a combustion chamber. The door is provided with first air inlet holes and second air inlet holes. The baffle is provided with first air holes. The baffle is provided with an air guide port and an air guide face. First partial air flows backward in the air inlet chamber, flows through the air guide port and the air guide face, and flows upward into the combustion chamber, and second partial air in the air inlet chamber flows through the first air holes into the combustion chamber. The first partial air and the second partial air form a vortex air flow in the combustion chamber.

13 Claims, 15 Drawing Sheets

B - B

E - E

PORTABLE BURNING STOVE PROVIDING WARM AIR

BACKGROUND OF THE INVENTION

1. Field of the Invention

The present invention relates to a stove and, more particularly, to a portable burning stove.

2. Description of the Related Art

A conventional burning stove comprises a fire box, a support rack (or grate) mounted in the fire box, and a door pivotally connected with the fire box. The support rack is used for placing a fire source, such as wood, charcoal or the like. The door is provided an air vent corresponding to the support rack to introduce ambient air into the fire box. However, the ashes produced during burning easily block the air circulation, such that the flame is not burned completely. In addition, the fire embers directly fall through the gaps of the support rack onto the bottom of the fire box, thereby causing inconvenience to the user in clearing the trashes.

The closest prior art reference was disclosed in U.S. Pat. No. 4,430,986 to Thalis, filed on Feb. 19, 1982, entitled "FUEL BURNING STOVE WITH HANDLE OPERATED DAMPER AND BAFFLE MEANS".

BRIEF SUMMARY OF THE INVENTION

The primary objective of the present invention is to provide a portable burning stove for providing warm air in camping.

In accordance with the present invention, there is provided a burning stove comprising a stove body, a front seat mounted on the stove body, a door mounted on the front seat, a rear seat mounted on the stove body, a top cover mounted on the stove body, a mounting tube mounted on the top cover, a chimney mounted on the mounting tube, a baffle mounted in the stove body, and dividing an interior of the stove body into an air inlet chamber and a combustion chamber, and a grate mounted in the stove body. The air inlet chamber of the stove body is located under the baffle, and the combustion chamber of the stove body is located above the baffle. A gap is defined between the baffle and the grate. The door is provided with a plurality of first air inlet holes corresponding to the air inlet chamber of the stove body, and a plurality of second air inlet holes corresponding to the combustion chamber of the stove body. The baffle is provided with a plurality of first air holes. The baffle is provided with an air guide port corresponding to the mounting tube, and an air guide face corresponding to the mounting tube. First partial air flows backward in the air inlet chamber of the stove body, flows through the air guide port and the air guide face of the baffle, and flows upward into the combustion chamber of the stove body, and second partial air in the air inlet chamber of the stove body flows through the first air holes of the baffle into the combustion chamber of the stove body. The first partial air and the second partial air form a vortex air flow in the combustion chamber of the stove body.

According to the primary advantage of the present invention, a vortex air flow is formed in the combustion chamber of the stove body, so as to enhance the air convection effect during the burning process.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
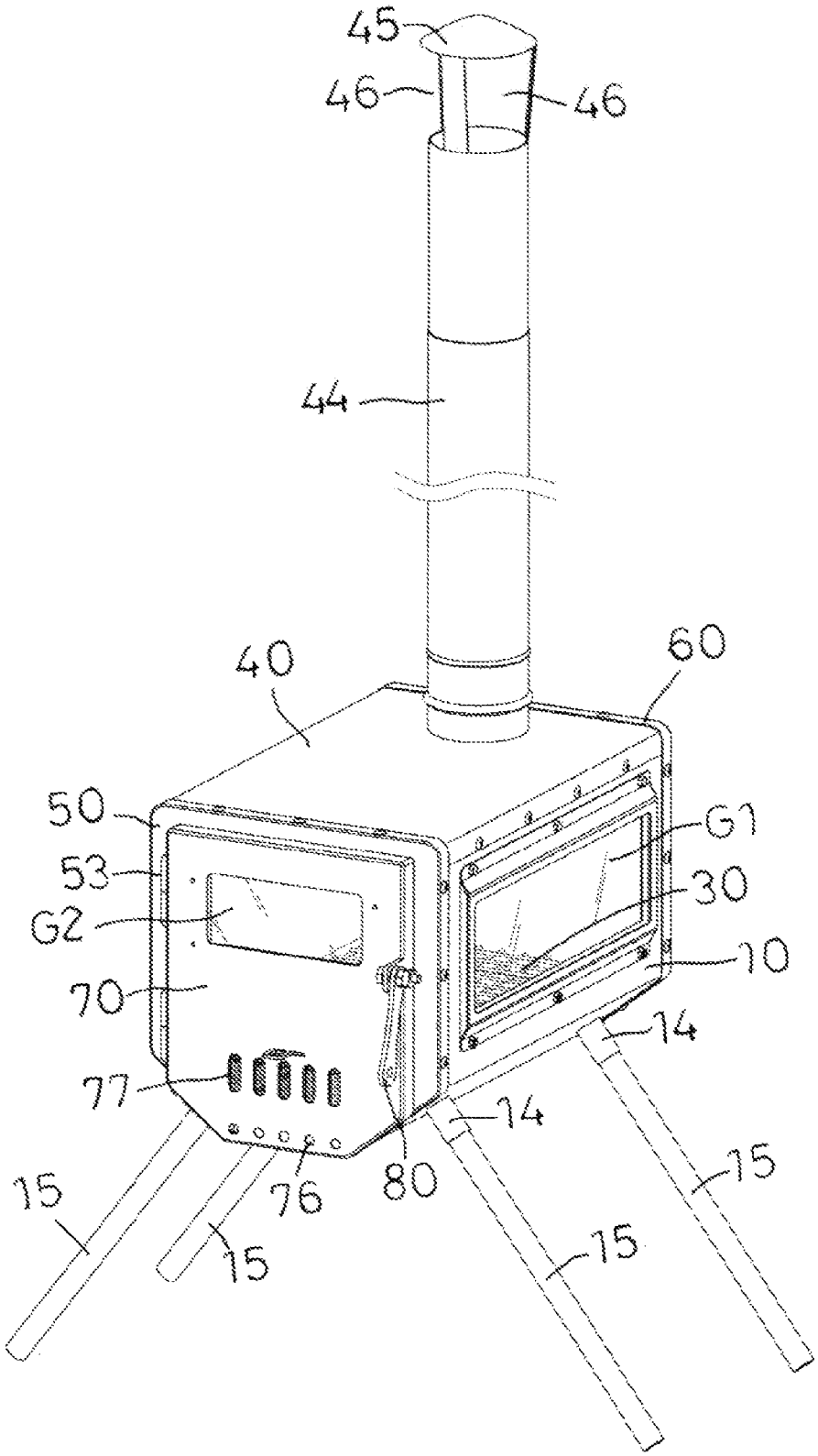
FIG. 1 is a perspective view of a burning stove in accordance with the preferred embodiment of the present invention.
Figure 2:
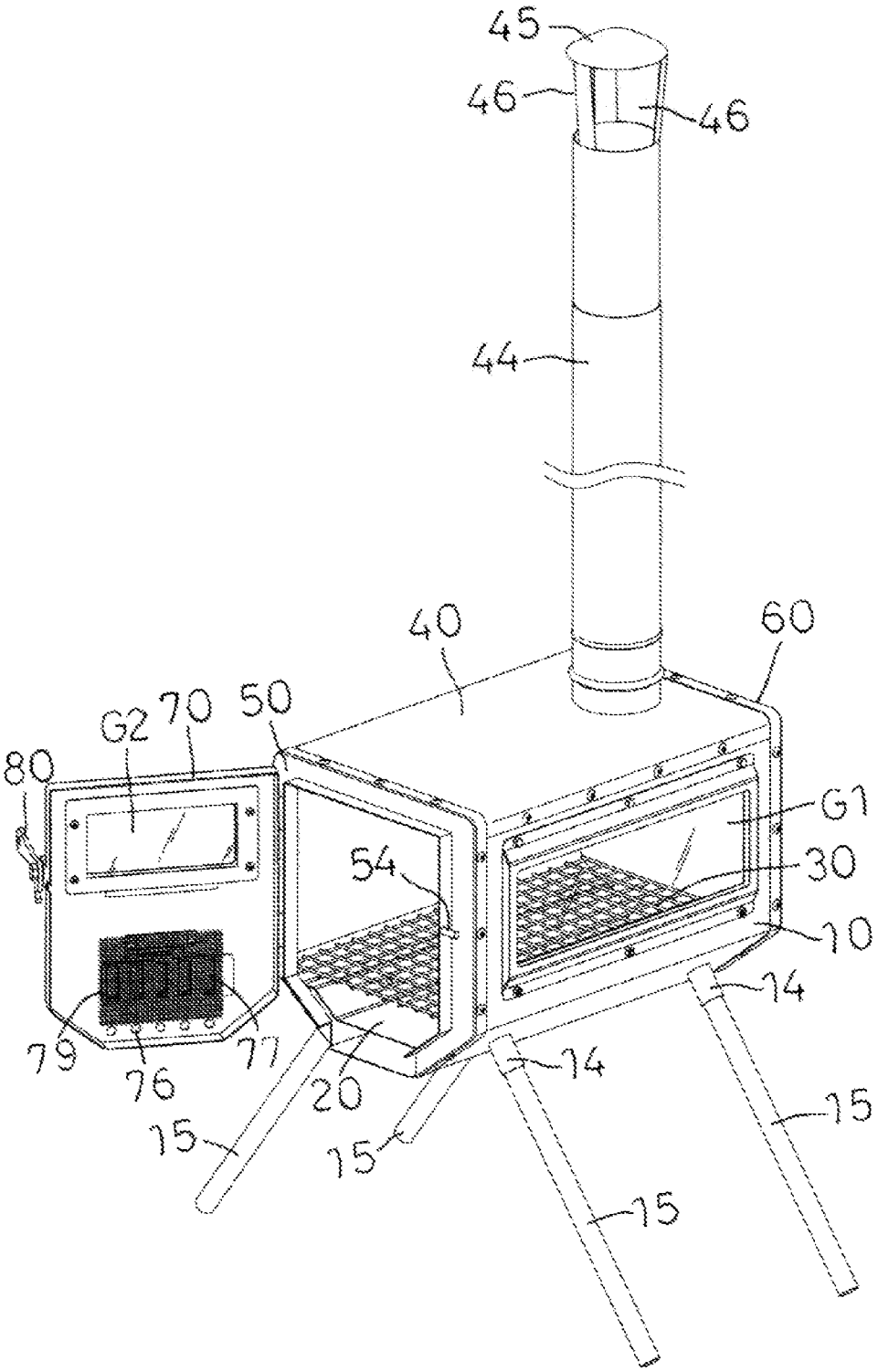
FIG. 2 is a perspective view showing the door of the burning stove is opened.
Figure 3:
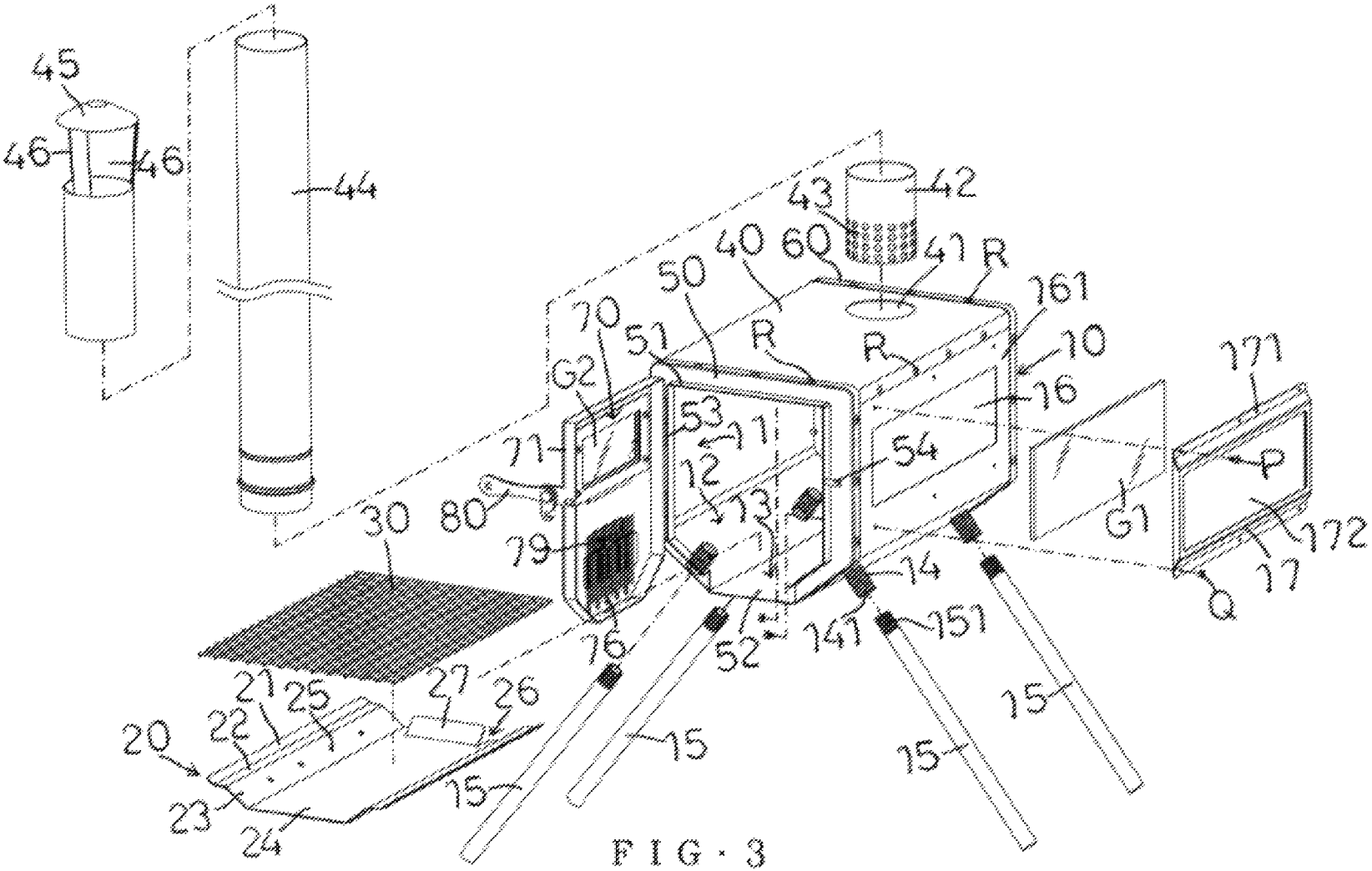
FIG. 3 is a partial exploded perspective view of the burning stove in accordance with the preferred embodiment of the present invention.
Figure 4:
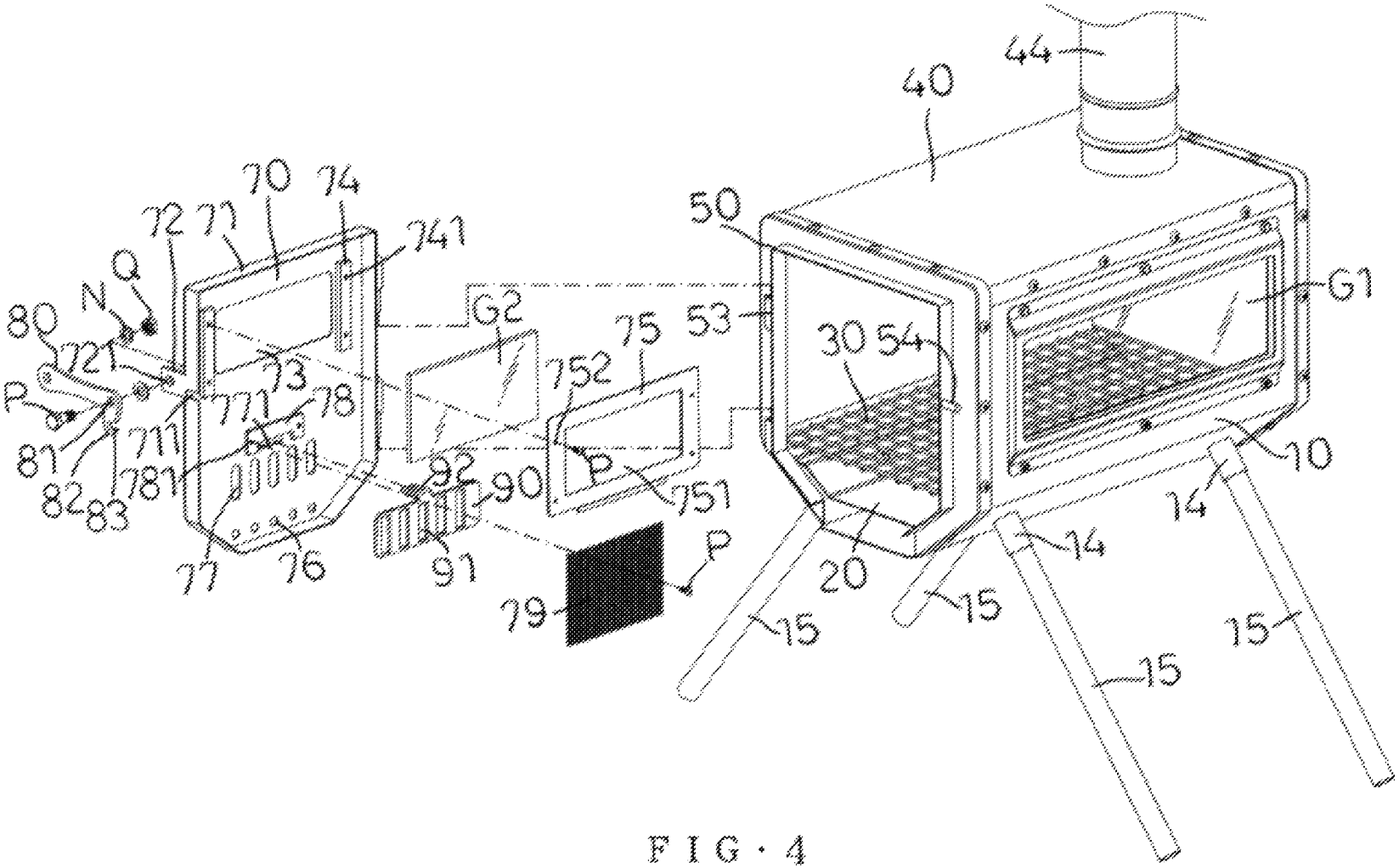
FIG. 4 is another partial exploded perspective view of the burning stove in accordance with the preferred embodiment of the present invention.
Figure 5:
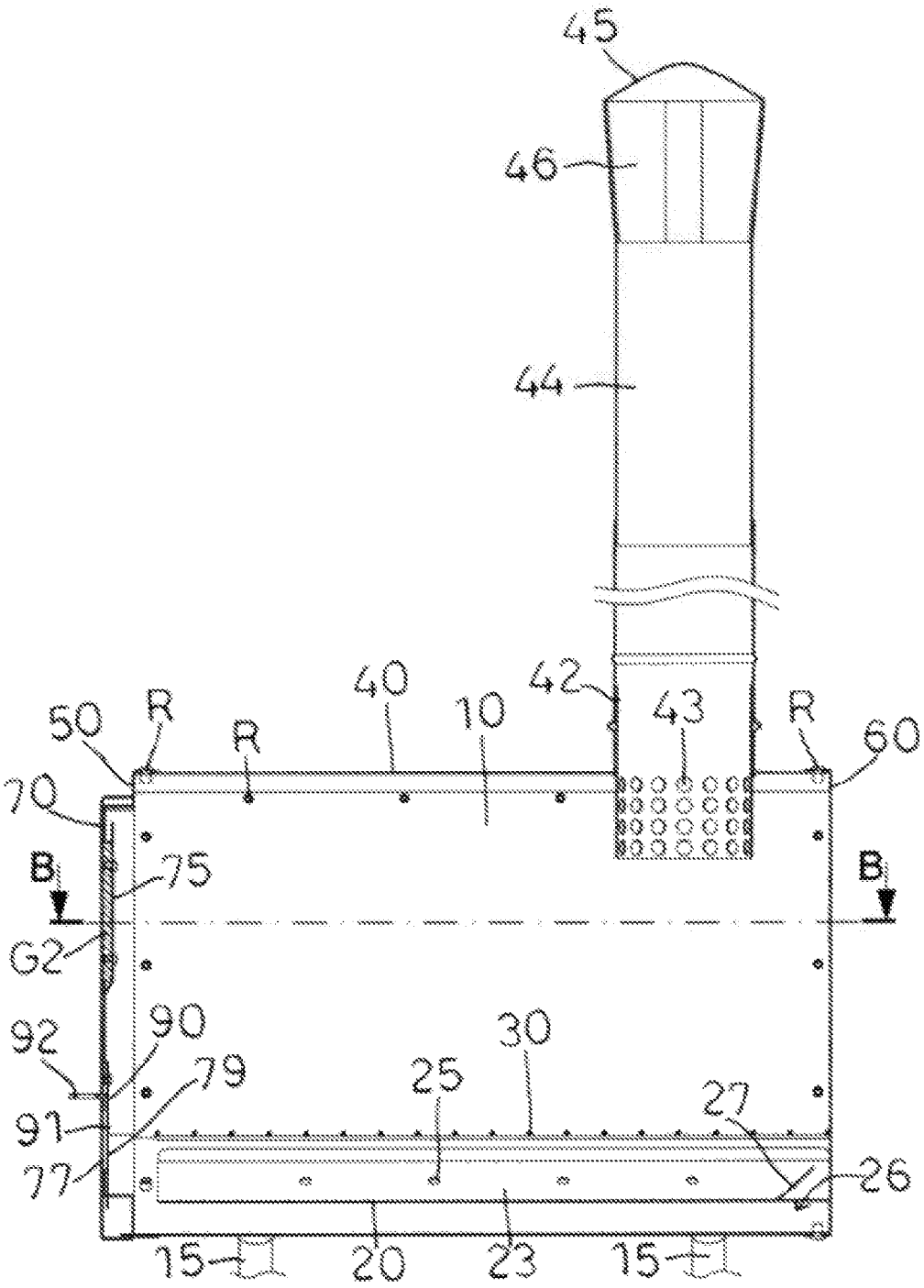
FIG. 5 is a cross-sectional view of the burning stove in accordance with the preferred embodiment of the present invention.
Figure 6:
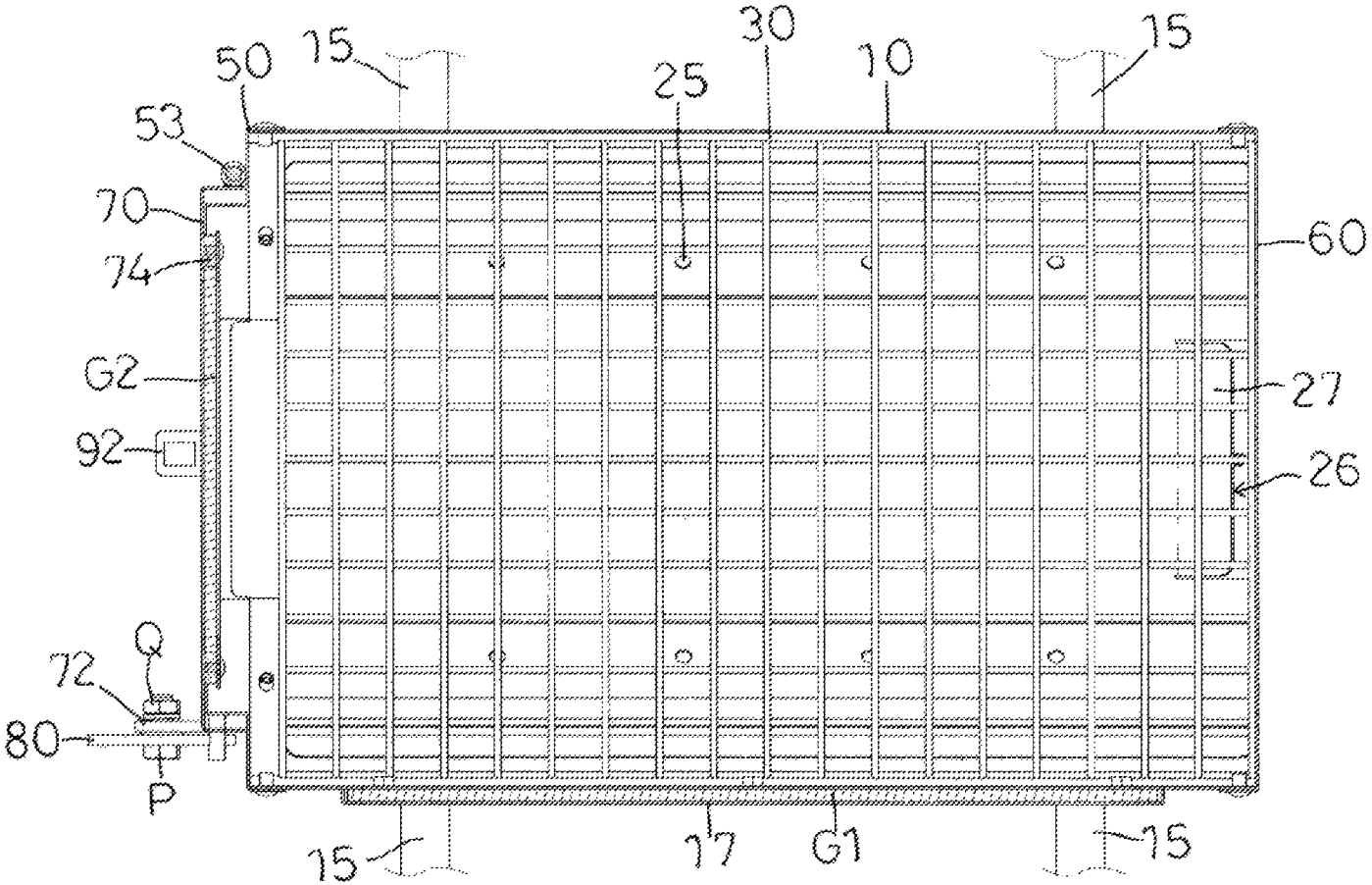
FIG. 6 is a cross-sectional view of the burning stove taken along line B-B as shown in FIG. 5.

Referring to the drawings and initially to FIGS. 1-12, a burning stove in accordance with the preferred embodiment of the present invention comprises a stove body (or fire box) 10, a front seat 50 mounted on the stove body 10, a door 70 mounted on the front seat 50, a rear seat 60 mounted on the stove body 10, a top cover 40 mounted on the stove body 10, a mounting tube 42 mounted on the top cover 40, a chimney 44 mounted on the mounting tube 42, a baffle 20 mounted in the stove body 10, and dividing an interior of the stove body 10 into an air inlet chamber and a combustion chamber, and a grate 30 mounted in the stove body 10.

The air inlet chamber of the stove body 10 is located under the baffle 20, and the combustion chamber of the stove body 10 is located above the baffle 20. A gap "C" is defined between the baffle 20 and the grate 30. The door 70 is provided with a plurality of circular first air inlet holes 76 corresponding to the air inlet chamber of the stove body 10, and a plurality of elongated second air inlet holes 77 corresponding to the combustion chamber of the stove body 10. The baffle 20 is provided with a plurality of first air holes 25. The baffle 20 is provided with an air guide port 26 corresponding to the mounting tube 42, and an upward bent air guide face 27 corresponding to the mounting tube 42. Thus, first partial air flows backward in the air inlet chamber of the stove body 10, flows through the air guide port 26 and the air guide face 27 of the baffle 20, and flows upward into the combustion chamber of the stove body 10, and second partial air in the air inlet chamber of the stove body 10 flows through the first air holes 25 of the baffle 20 into the combustion chamber of the stove body 10. The first partial air and the second partial air form a vortex air flow in the combustion chamber of the stove body 10, so as to enhance the air convection effect during the burning process.

Figure 7:
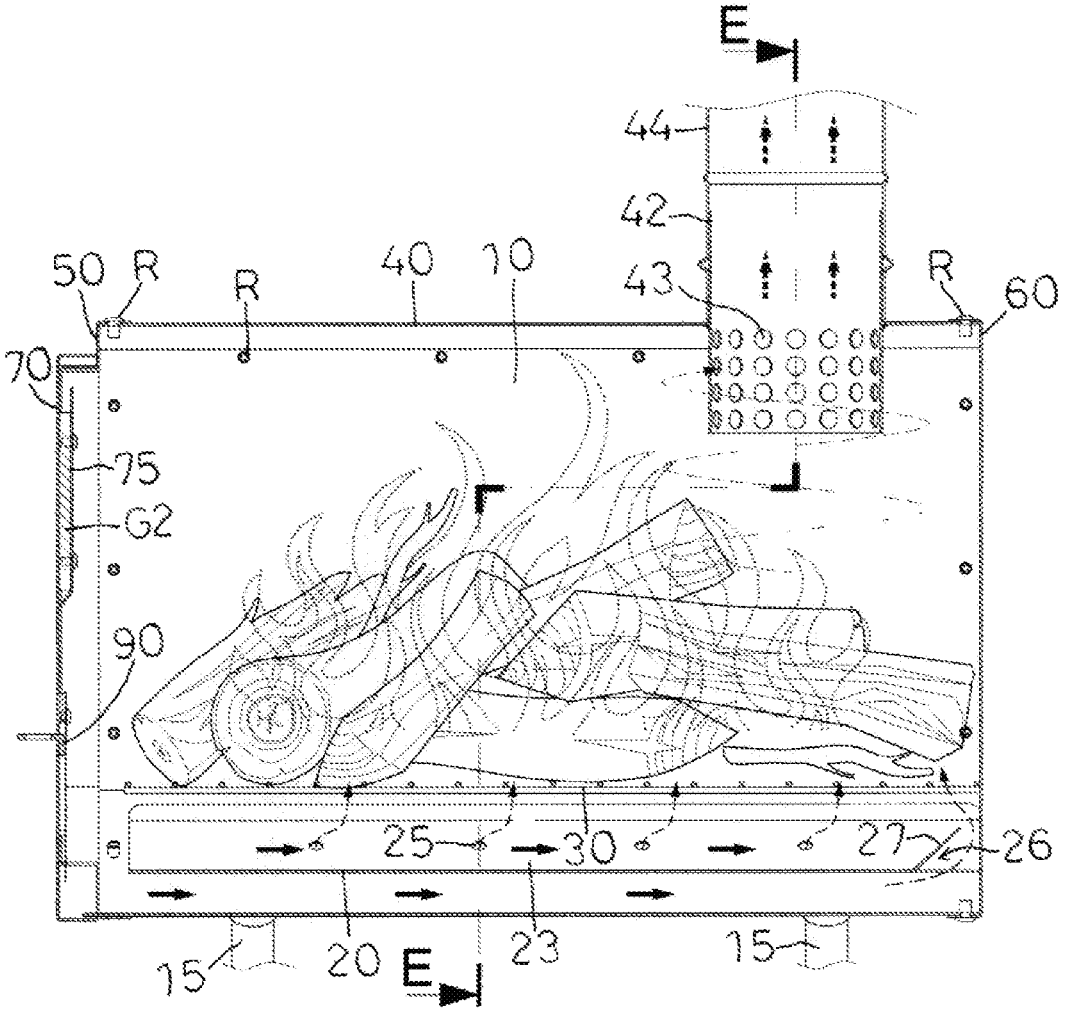
FIG. 7 is a cross-sectional view showing a vortex air flow produced by the burning stove.
Figure 8:
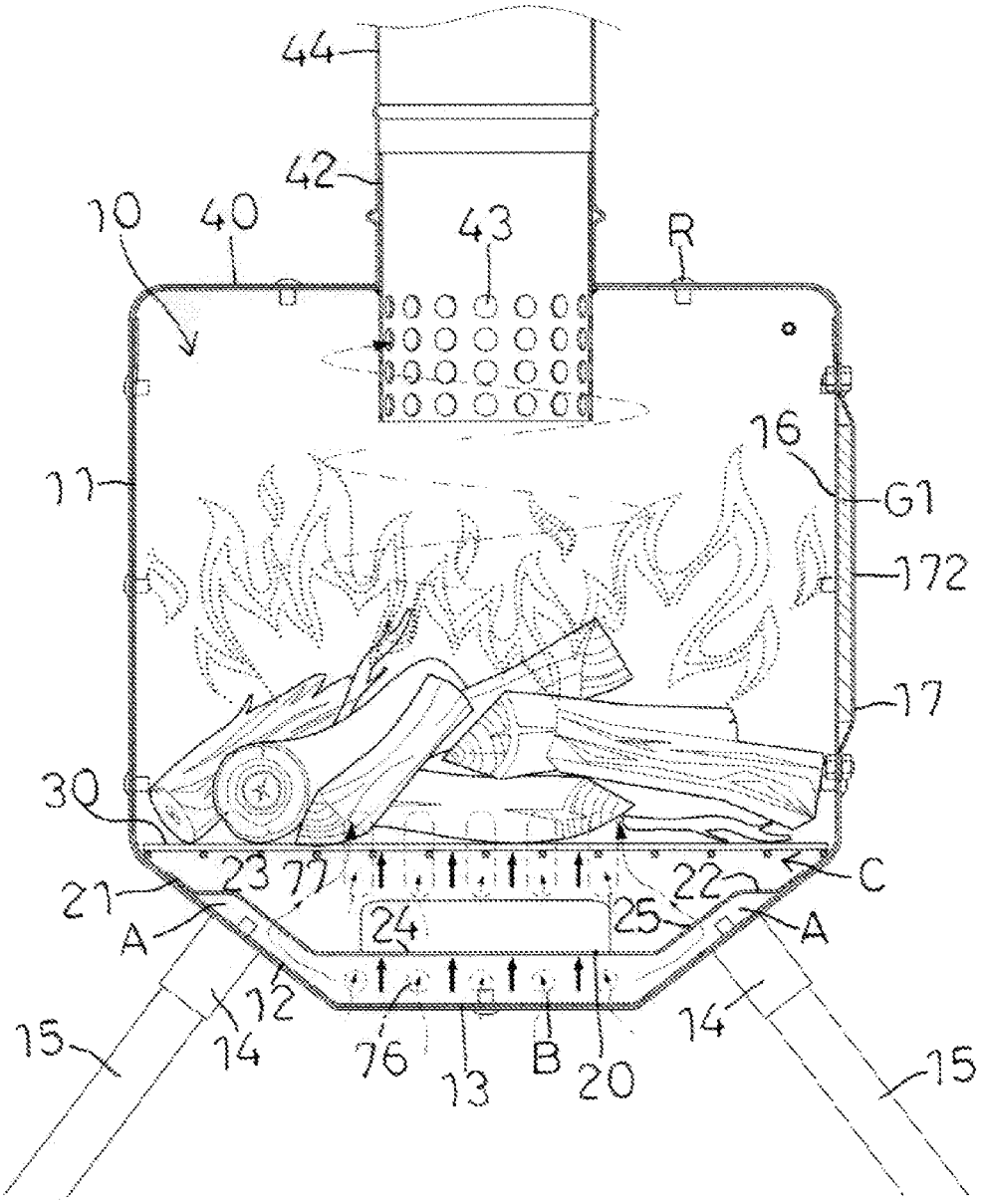
FIG. 8 is a cross-sectional view of the burning stove taken along line E-E as shown in FIG. 7.

In the preferred embodiment of the present invention, the stove body 10 includes two side plates 11, two oblique plates 12 each mounted on a lower end of one of the two side plates 11, and a bottom plate 13 disposed between the two oblique plates 12. The two side plates 11 are disposed at an upright state. The two oblique plates 12 are inclined inward. The bottom plate 13 is disposed at a horizontal state. The baffle 20 is disposed between the two oblique plates 12 of the stove body 10. The baffle 20 includes two first ramps 21, two first planes (or flat surfaces) 22 extending inward from the two first ramps 21 respectively, two second ramps 23 extending downward from the two first planes 22 respectively, and a second plane (or flat surface) 24 disposed between the two second ramps 23. The two first ramps 21 of the baffle 20 rest on the two oblique plates 12 of the stove body 10. A first circulation space "A" is defined between the two second ramps 23 of the baffle 20 and the two oblique plates 12 of the stove body 10. A second circulation space "B" is defined between the second plane 24 of the baffle 20 and the bottom plate 13 of the stove body 10. The first circulation space "A" is connected to the second circulation space "B". The first air holes 25 of the baffle 20 are formed in the two second ramps 23, such that the air in the first circulation space "A" is introduced through the first air holes 25 of the baffle 20 into the combustion chamber of the stove body 10. In addition, the air in the second circulation space "B" is guided through the air guide port 26 and the air guide face 27 of the baffle 20, and flows upward into the combustion chamber of the stove body 10. Thus, the air from the first circulation space "A" and the air from the second circulation space "B" are combined in the combustion chamber of the stove body 10 so as to form the vortex air flow as shown in FIGS. 7 and 8.

Figure 9:
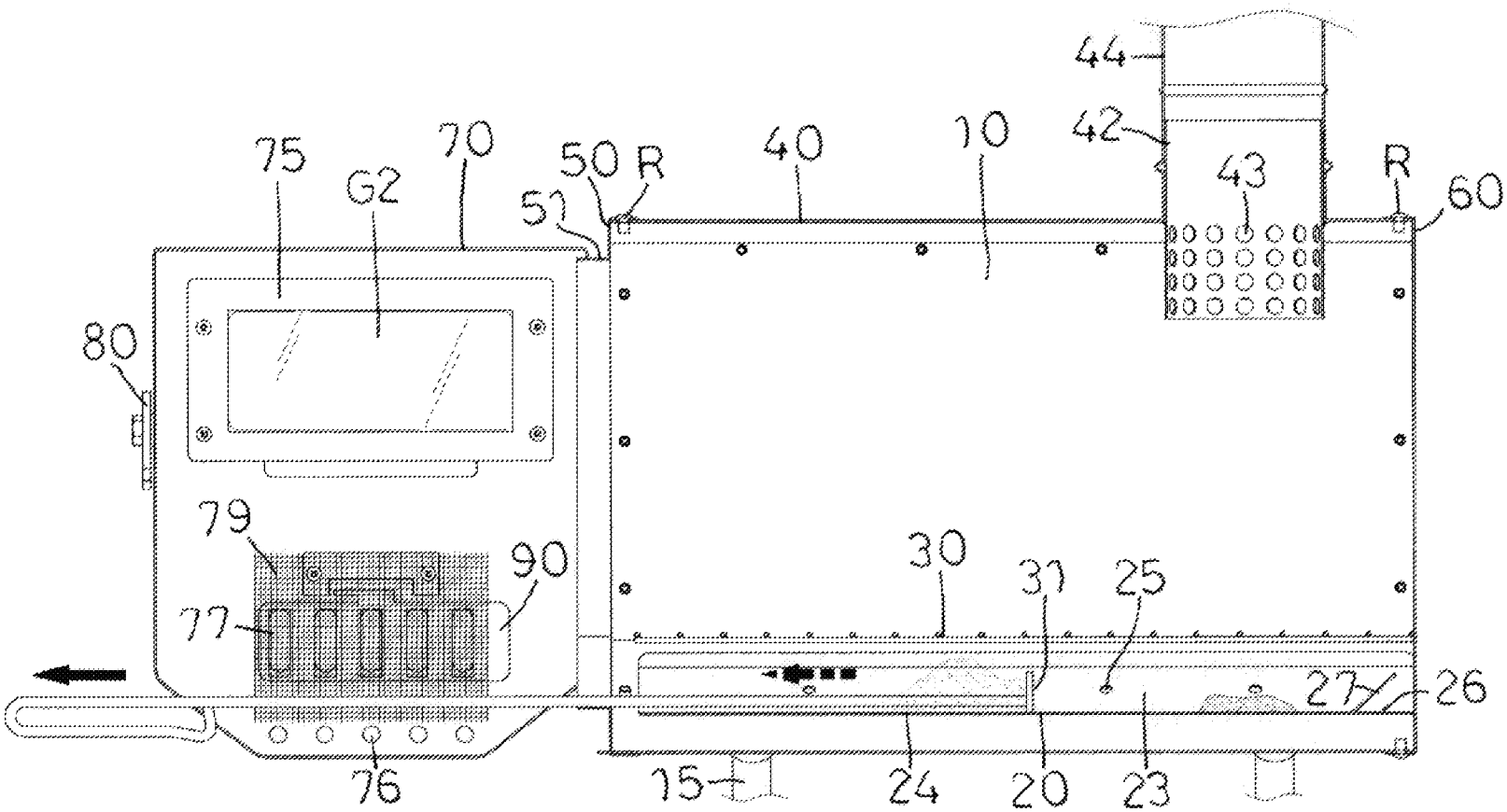
FIG. 9 is a schematic operational view showing the ashes are cleared by an elongated bar.

In the preferred embodiment of the present invention, the grate 30 is located between the two side plates 11 and the two oblique plates 12 of the stove body 10, and is disposed above the baffle 20, for placing a fire source or fuel, such as wood, charcoal or the like. The ashes produced after burning drop through the grate 30 onto the baffle 20, and are pushed outward by a push bar 31 as shown in FIG. 9. Thus, the user clears the ashes easily and conveniently.

In the preferred embodiment of the present invention, the burning stove further comprises a plurality of (preferably four) support legs 14 mounted on a bottom of the stove body 10, and a plurality of (preferably four) extensions 15 connected with the support legs 14. The support legs 14 are disposed on the two oblique plates 12 of the stove body 10 and are disposed at an inclined state. Each of the support legs 14 is provided with an internal thread 141, and each of the extensions 15 is provided with an external thread 151 screwed into the internal thread 141 of each of the support legs 14. Thus, the extensions 15 increase the height of the stove body 10 to prevent the bottom of the stove body 10 from too close to the grass on the ground.

In the preferred embodiment of the present invention, the stove body 10 is provided with a first opening 16. A first window frame 17 is mounted on the first opening 16 of the stove body 10, and is provided with a first slot 172 corresponding to the first opening 16 of the stove body 10. A first window "G1" is mounted on the first slot 172 of the first window frame 17 and located between the first window frame 17 and the stove body 10. Thus, the first window "G1" facilitates the user observing the burning flame in the stove body 10 to get a spiritual peace.

In the preferred embodiment of the present invention, the door 70 is provided with a second opening 73 having a rectangular shape. A second window frame 75 is mounted on the second opening 73 of the door 70, and is provided with a second slot 751 corresponding to the second opening 73 of the door 70. A second window "G2" is mounted on the second slot 751 of the second window frame 75 and located between the second window frame 75 and the door 70. Thus, the second window "G2" facilitates the user watching the burning state in the stove body 10.

In the preferred embodiment of the present invention, the mounting tube 42 extends into the stove body 10 and has a periphery provided with a plurality of second air holes 43. The chimney 44 includes multiple sections connected together. A cap 45 is mounted on a top of the chimney 44 to prevent the flame from surging upward, and has a periphery provided with a plurality of exhaust holes 46 to drain smoke outwardly and transversely. The top cover 40 is provided with a circular through hole 41 allowing passage of the mounting tube 42.

Figure 10:
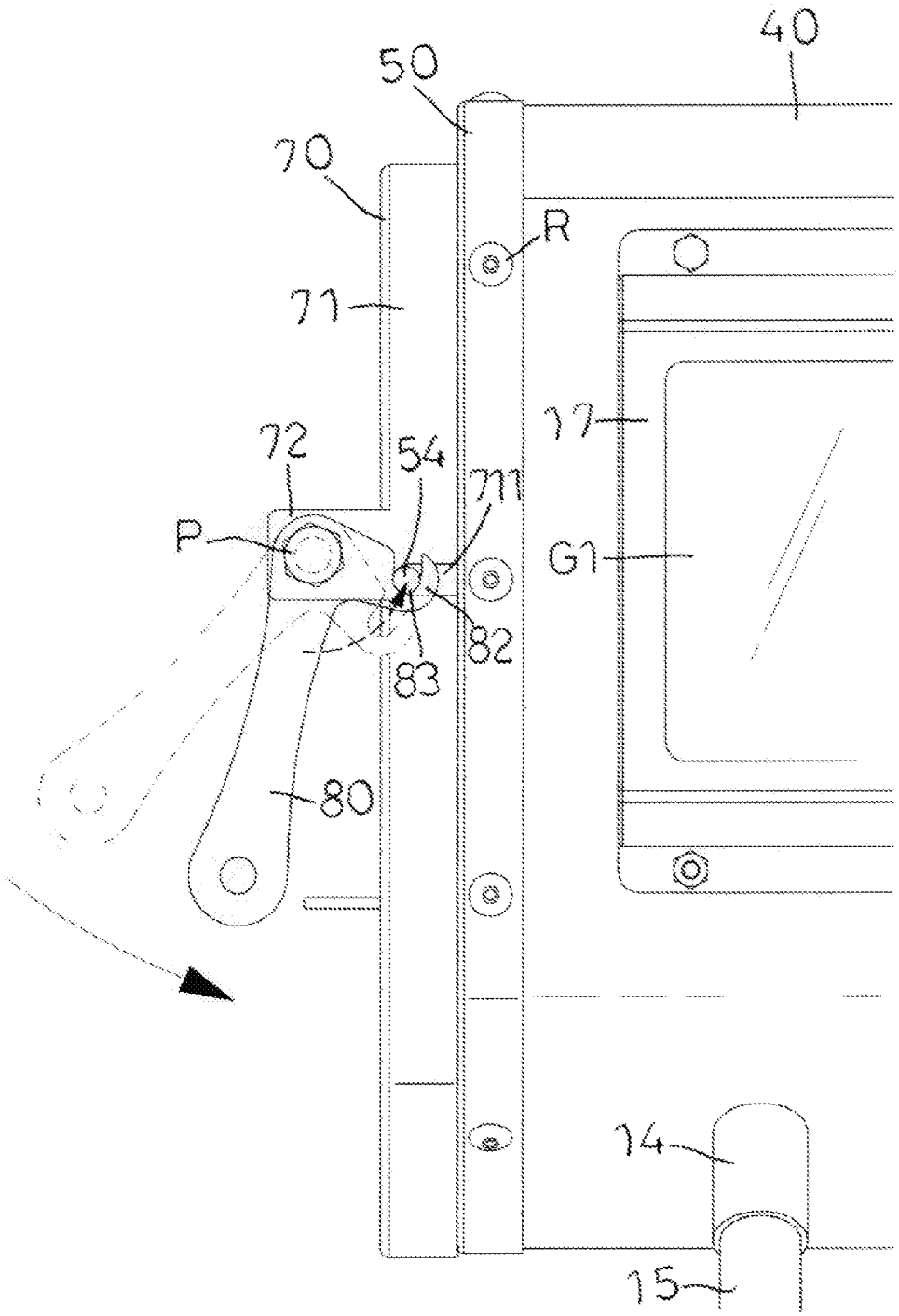
FIG. 10 is a schematic operational view showing action of the handle of the burning stove.

In the preferred embodiment of the present invention, a flange 51 is mounted on the front seat 50 by soldering and has a lower end provided with a breach 52. The flange 51 has a first side provided with a set of hinge 53 and a second side provided with a latch 54, and the door 70 is connected with the set of hinge 53, such that the door 70 is pivotally connected with the flange 51 and the front seat 50. The door 70 is provided with a protruding ear 72 which is provided with a pivot hole 721. A handle 80 is pivotally mounted on the protruding ear 72 of the door 70 and has an L-shaped configuration. The handle 80 is provided with a pivot hole 81 pivotally connected with the pivot hole 721 of the protruding ear 72. The handle 80 is provided with a hooked portion 82 which is provided with a hooked hole 83 corresponding to the latch 54 of the flange 51. The hooked hole 83 of the handle 80 is hooked onto the latch 54 of the flange 51 by pivotal movement of the handle 80 as shown in FIG. 10, so as to close the door 70.

Figure 12:
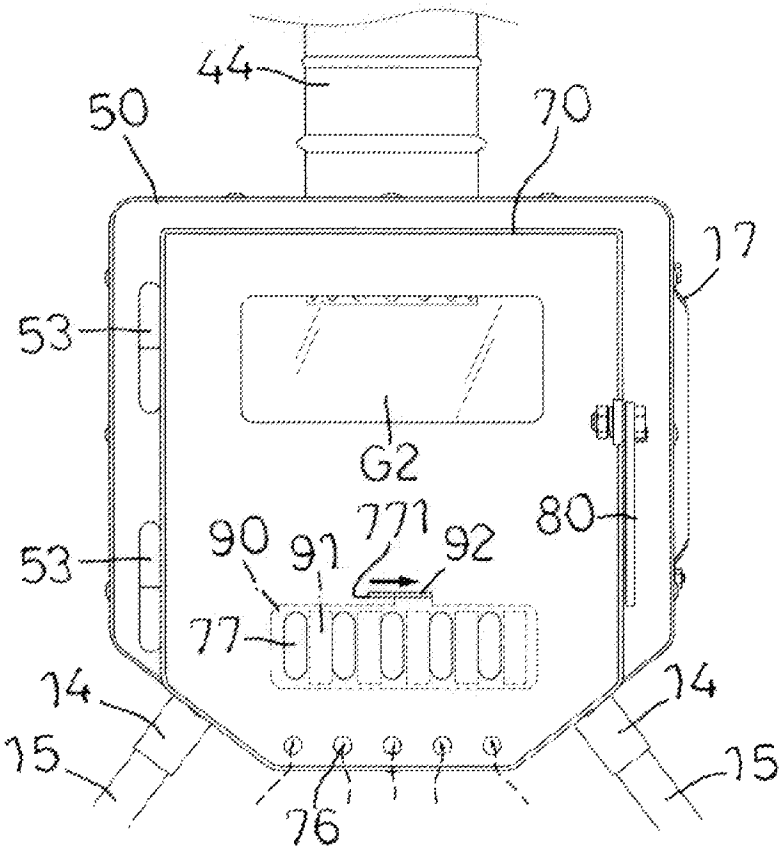
FIG. 12 is a schematic operational view showing action of the adjustment member, wherein the second air inlet holes are closed.
Figure 11:
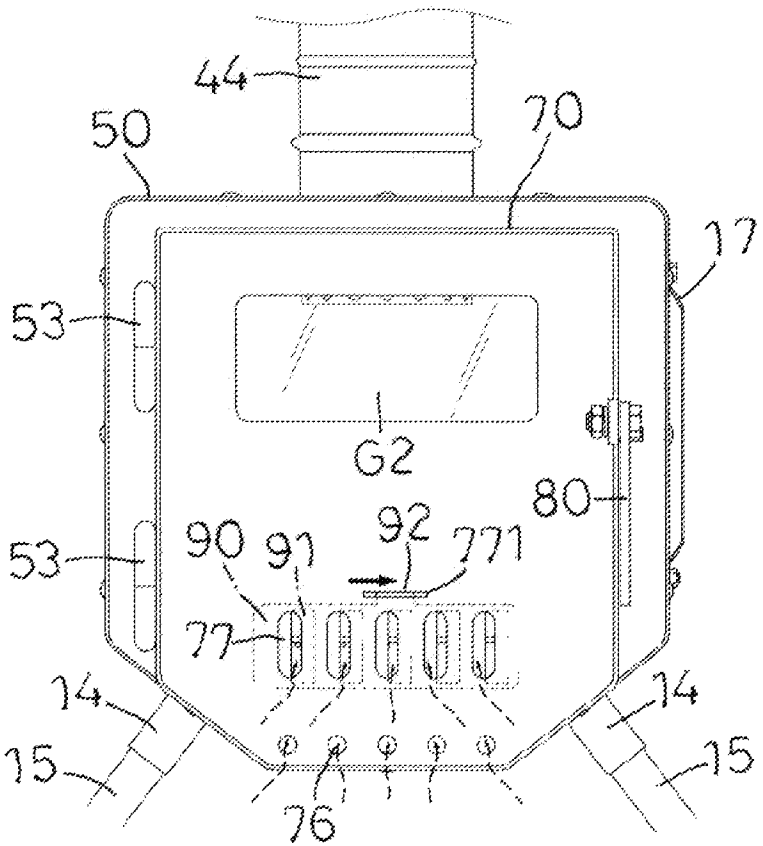
FIG. 11 is a schematic operational view showing action of the adjustment member, wherein the second air inlet holes are half opened.

In the preferred embodiment of the present invention, the door 70 is provided with a transverse slit 771 located above the second air inlet holes 77 and disposed transversely. An adjusting member 90 is mounted on the door 70, and is provided with a plurality of third air inlet holes 91 corresponding to the second air inlet holes 77 of the door 70. The adjusting member 90 is a sheet plate provided with a driving piece 92 extending through and protruding outward from the slit 771 of the door 70. The third air inlet holes 91 of the adjusting member 90 are moved relative to the second air inlet holes 77 of the door 70 by transverse movement of the adjusting member 90, to regulate an air input amount through the second air inlet holes 77 of the door 70 and the third air inlet holes 91 of the adjusting member 90 into the stove body 10, and to control a burning flame. Thus, when the driving piece 92 is driven by the user, the adjusting member 90 is moved relative to the door 70, such that the third air inlet holes 91 of the adjusting member 90 align with, partially align with or misalign with the second air inlet holes 77 of the door 70, so as to regulate the air input amount as shown in FIGS. 11 and 12. Thus, the adjusting member 90 is used to control the strength of the flame.

In the preferred embodiment of the present invention, at least one fastening piece 78 is secured to the door 70 by soldering, and is located above the second air inlet holes 77 and the slit 771. A metallic net (or voile) 79 is mounted on and fastened by the at least one fastening piece 78, and covers the second air inlet holes 77 of the door 70 and the third air inlet holes 91 of the adjusting member 90 to prevent the ashes from flying outward from the door 70.

In the preferred embodiment of the present invention, the first opening 16 of the stove body 10 has a rectangular shape and is located at one of one of the two side plates 11. The stove body 10 is provided with a plurality of through holes 161, and the first window frame 17 is provided with a plurality of through holes 171 connected with the through holes 161 of the stove body 10 by a plurality of screws "P" and nuts "Q". Thus, when the first window "G1" is worn out or broken, the screws "P" and the nuts "Q" are unscrewed and detached for replacement of the first window "G1".

In the preferred embodiment of the present invention, the two side plates 11, the two oblique plates 12, and the bottom plate 13 of the stove body 10 are connected with the top cover 40, the front seat 50, and the rear seat 60 by a plurality of rivets "R".

In the preferred embodiment of the present invention, the top cover 40 has a substantially inverted U-shaped longitudinal cross-sectional configuration, and is combined integrally with the front seat 50, the rear seat 60, and the stove body 10 by the rivets "R".

In the preferred embodiment of the present invention, the front seat 50 has a longitudinal cross-sectional configuration the same as that of the stove body 10, and is combined integrally with the stove body 10 and the top cover 40 by the rivets "R".

In the preferred embodiment of the present invention, the rear seat 60 has a longitudinal cross-sectional configuration the same as that of the stove body 10, and is combined integrally with the stove body 10 and the top cover 40 by the rivets "R".

In the preferred embodiment of the present invention, the door 70 has a longitudinal cross-sectional configuration the same as that of the stove body 10. The door 70 is provided with a wing 71 extending backward. The wing 71 of the door 70 is provided with a cutout 711 that receives (or escapes) the latch 54 of the flange 51 when the wing 71 of the door 70 rests on the flange 51 of the front seat 50. The pivot hole 81 of the handle 80 is pivotally connected with the pivot hole 721 of the protruding ear 72 by a screw "P", a washer "N", and a nut "Q", such that the handle 80 is pivotally connected with the protruding ear 72 of the door 70. The door 70 is provided with two racks 74 for mounting the second window "G2". The two racks 74 of the door 70 are located at two sides of the second opening 73. Each of the two racks 74 of the door 70 is provided with a plurality of screw holes 741, the second window frame 75 is provided with a plurality of through holes 752, and a plurality of screws "P" extend through the through holes 752 of the second window frame 75 and the screw holes 741 of each of the two racks 74, to combine the second window frame 75 with the two racks 74 of the door 70. The first air inlet holes 76 of the door 70 are connected to the second circulation space "B". The second air inlet holes 77 of the door 70 is located above the first air inlet holes 76. The at least one fastening piece 78 is provided with a plurality of screw holes 781 for screwing the screws "P", to securing the metallic net 79.

Figure 13:
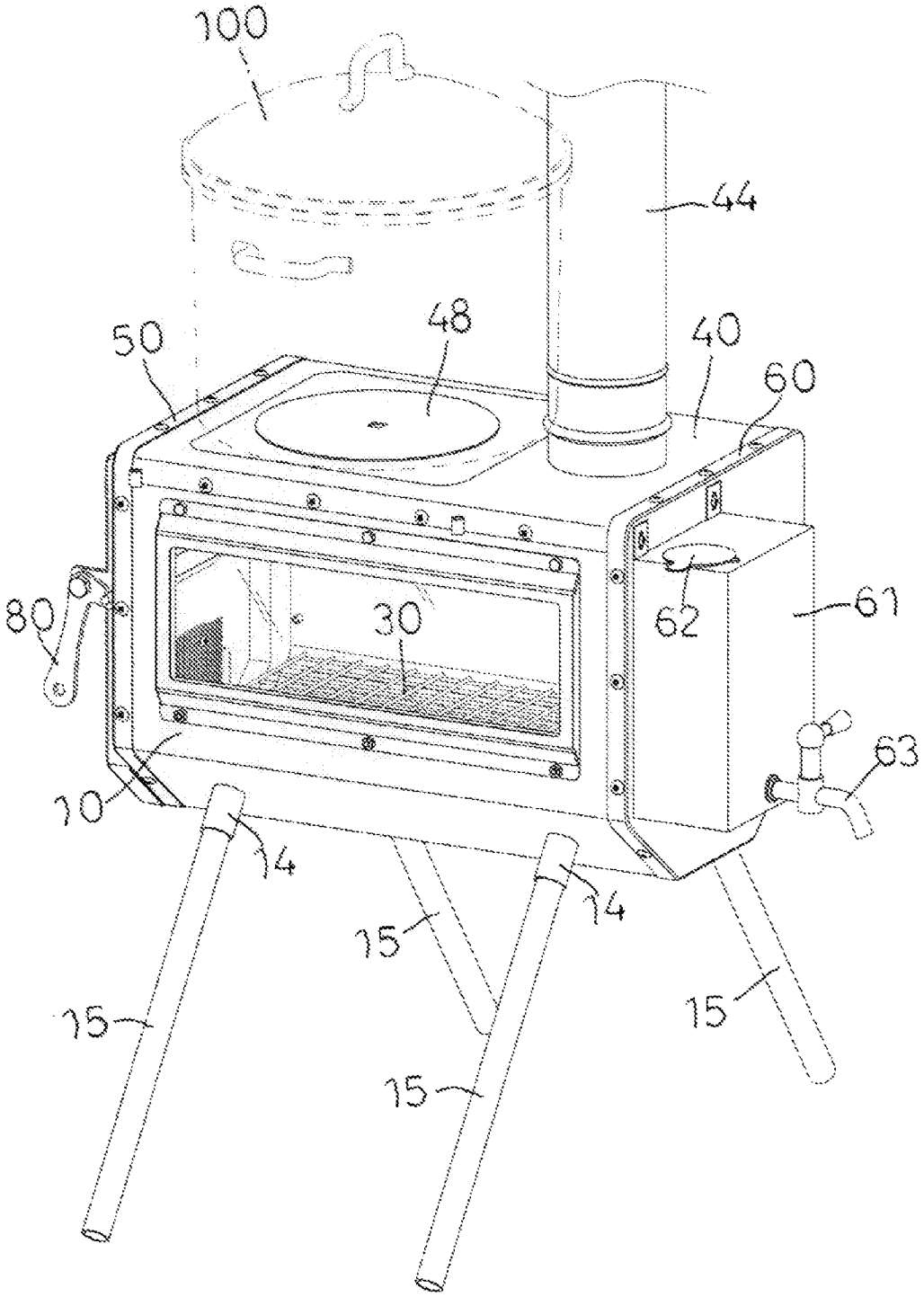
FIG. 13 is a perspective view of a burning stove in accordance with another preferred embodiment of the present invention.
Figure 14:
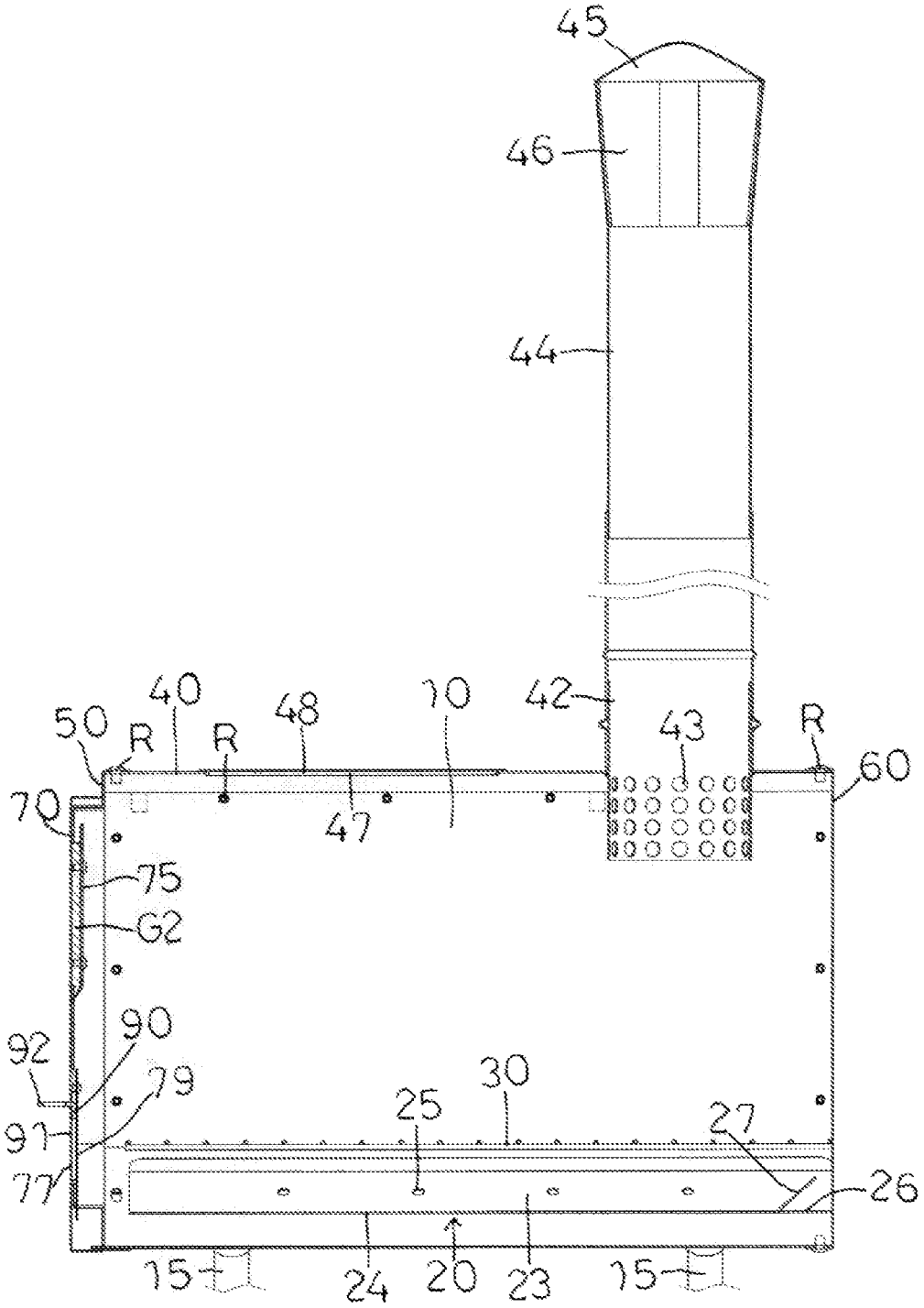
FIG. 14 is a cross-sectional view of the burning stove as shown in FIG. 13.

Referring to FIGS. 13 and 14 with reference to FIGS. 1-12, the top cover 40 is provided with a stove opening 47, and a heating plate 48 is placed on the top cover 40 and located above the stove opening 47. Thus, the heating plate 48 is used to heat and cook the food directly. A pot 100 may be placed on the heating plate 48. A water tank 61 is mounted on the rear seat 60. A lid 62 is mounted on an upper end of the water tank 61. The water is filled into the water tank 61 after the lid 62 is removed. A faucet 63 is mounted on a lower end of the water tank 61.

Figure 15:
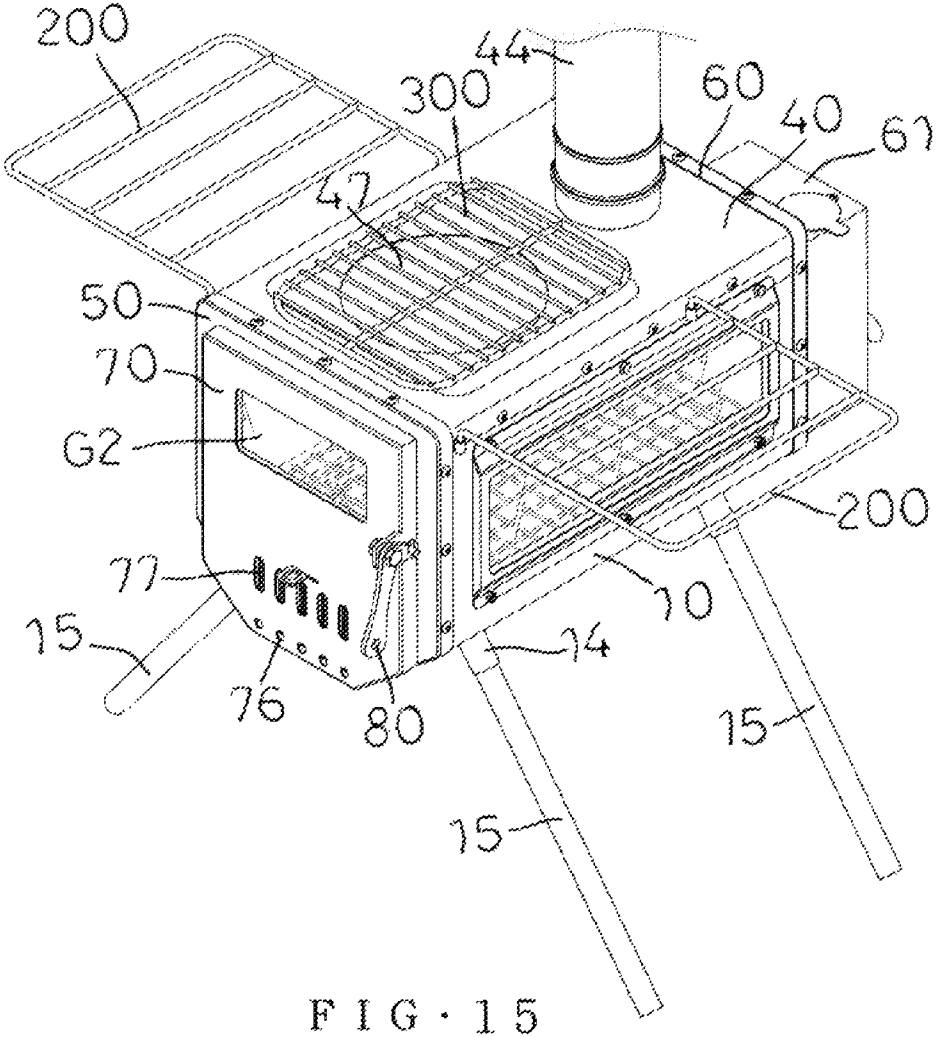
FIG. 15 is a perspective view of a burning stove in accordance with a further preferred embodiment of the present invention.
Figure 16:
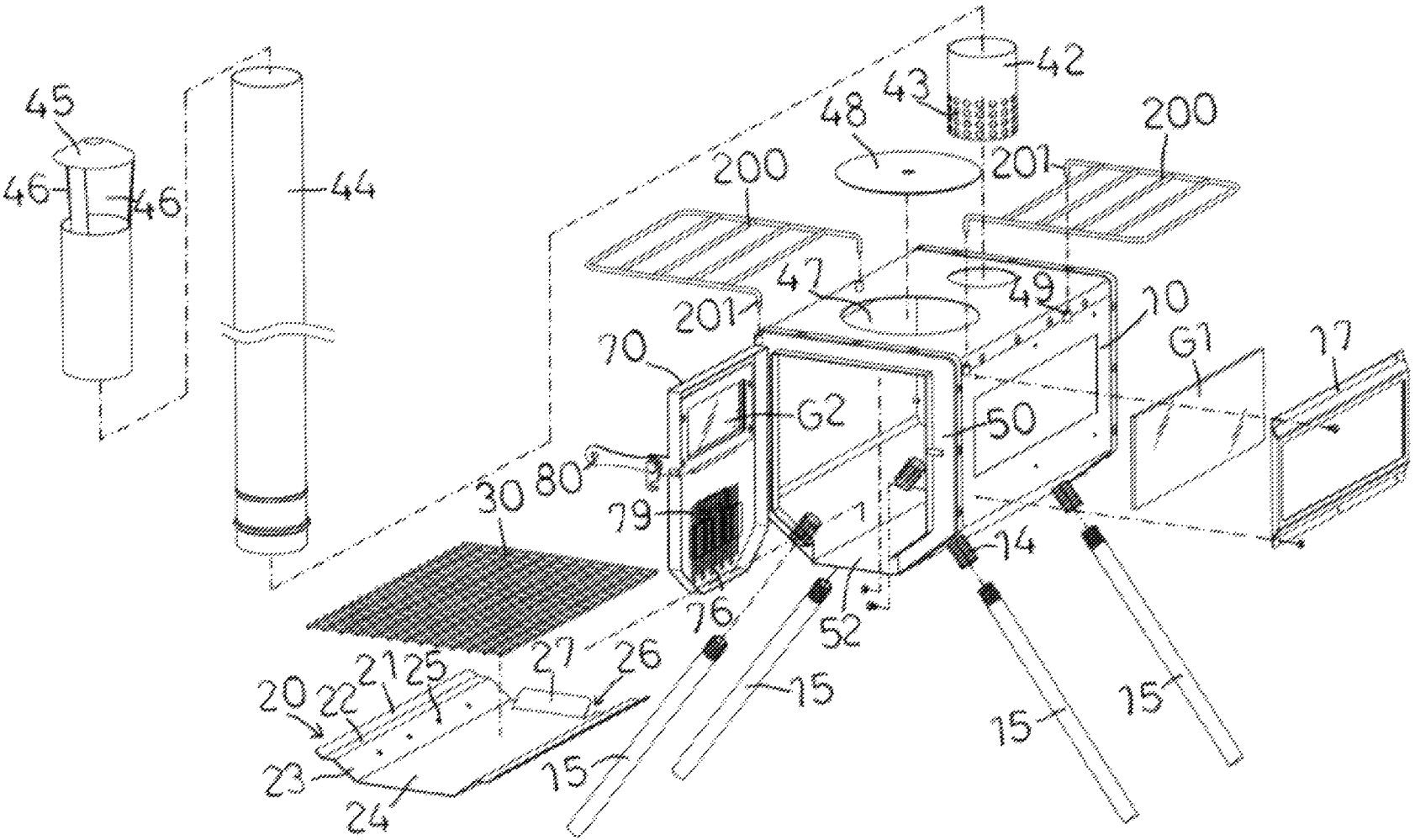
FIG. 16 is a partial exploded perspective view of the burning stove as shown in FIG. 15.

Referring to FIGS. 15 and 16 with reference to FIGS. 1-14, the burning stove further comprises two placement racks 200 mounted on the stove body 10 for placing food staples or cooking utensils. The stove body 10 is provided with a plurality of connecting tubes 49 for connecting the two placement racks 200. Each of the two placement racks 200 is provided with two connecting legs 201 inserted into the connecting tubes 49 of the stove body 10 respectively. A grill 300 is placed on the top cover 40 and located above the stove opening 47.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A burning stove comprising:

a stove body;

a front seat mounted on the stove body;

a door mounted on the front seat;

a rear seat mounted on the stove body;

a top cover mounted on the stove body;

a mounting tube mounted on the top cover;

a chimney mounted on the mounting tube;

a baffle mounted in the stove body, and dividing an interior of the stove body into an air inlet chamber and a combustion chamber; and a grate mounted in the stove body;

wherein:

the air inlet chamber of the stove body is located under the baffle;

the combustion chamber of the stove body is located above the baffle;

a gap is defined between the baffle and the grate;

the door is provided with a plurality of first air inlet holes corresponding to the air inlet chamber of the stove body, and a plurality of second air inlet holes corresponding to the combustion chamber of the stove body;

the baffle is provided with a plurality of first air holes;

the baffle is provided with an air guide port corresponding to the mounting tube, and an air guide face corresponding to the mounting tube;

first partial air flows backward in the air inlet chamber of the stove body, flows through the air guide port and the air guide face of the baffle, and flows upward into the combustion chamber of the stove body, and second partial air in the air inlet chamber of the stove body flows through the first air holes of the baffle into the combustion chamber of the stove body;

the first partial air and the second partial air form a vortex air flow in the combustion chamber of the stove body.

2. The burning stove of claim 1, wherein:

the stove body includes two side plates, two oblique plates each mounted on a lower end of one of the two side plates, and a bottom plate disposed between the two oblique plates;

the baffle is disposed between the two oblique plates of the stove body;

the baffle includes two first ramps, two first planes extending inward from the two first ramps respectively, two second ramps extending downward from the two first planes respectively, and a second plane disposed between the two second ramps;

the two first ramps of the baffle rest on the two oblique plates of the stove body;

a first circulation space is defined between the two second ramps of the baffle and the two oblique plates of the stove body;

a second circulation space is defined between the second plane of the baffle and the bottom plate of the stove body; and the first circulation space is connected to the second circulation space.

3. The burning stove of claim 1, further comprising:

a plurality of support legs mounted on a bottom of the stove body; and a plurality of extensions connected with the support legs; wherein:

each of the support legs is provided with an internal thread; and each of the extensions is provided with an external thread screwed into the internal thread of each of the support legs.

4. The burning stove of claim 1, wherein:

the stove body is provided with a first opening;

a first window frame is mounted on the first opening of the stove body, and is provided with a first slot corresponding to the first opening of the stove body; and a first window is mounted on the first slot of the first window frame.

5. The burning stove of claim 4, wherein:

the door is provided with a second opening;

a second window frame is mounted on the second opening of the door, and is provided with a second slot corresponding to the second opening of the door; and a second window is mounted on the second slot of the second window frame.

6. The burning stove of claim 1, wherein:

the mounting tube extends into the stove body and has a periphery provided with a plurality of second air holes;

the chimney includes multiple sections connected together; and a cap is mounted on a top of the chimney, and has a periphery provided with a plurality of exhaust holes to drain smoke outwardly and transversely.

7. The burning stove of claim 1, wherein:

a flange is mounted on the front seat;

the flange has a first side provided with a set of hinge and a second side provided with a latch;

the door is connected with the set of hinge;

the door is provided with a protruding ear which is provided with a pivot hole;

a handle is pivotally mounted on the protruding ear of the door;

the handle is provided with a pivot hole pivotally connected with the pivot hole of the protruding ear;

the handle is provided with a hooked portion which is provided with a hooked hole corresponding to the latch of the flange; and the hooked hole of the handle is hooked onto the latch of the flange by pivotal movement of the handle.

8. The burning stove of claim 1, wherein:

the door is provided with a slit located above the second air inlet holes;

an adjusting member is mounted on the door, and is provided with a plurality of third air inlet holes corresponding to the second air inlet holes of the door;

the adjusting member is provided with a driving piece extending through and protruding outward from the slit of the door; and the third air inlet holes of the adjusting member are moved relative to the second air inlet holes of the door by transverse movement of the adjusting member.

9. The burning stove of claim 1, wherein at least one fastening piece is secured to the door, and is located above the second air inlet holes, and a metallic net is mounted on and fastened by the at least one fastening piece, and covers the second air inlet holes of the door.

10. The burning stove of claim 1, wherein the top cover is provided with a stove opening, and a heating plate is placed on the top cover and located above the stove opening.

11. The burning stove of claim 1, wherein:

two placement racks are mounted on the stove body;

the stove body is provided with a plurality of connecting tubes for connecting the two placement racks; and each of the two placement racks is provided with two connecting legs inserted into the connecting tubes of the stove body respectively.

12. The burning stove of claim 1, wherein:

a water tank is mounted on the rear seat;

a lid is mounted on an upper end of the water tank; and a faucet is mounted on a lower end of the water tank.

13. The burning stove of claim 1, wherein the top cover is provided with a stove opening, and a grill is placed on the top cover and located above the stove opening.

* * * * *